US012471700B2

(12) United States Patent
Conway et al.

(10) Patent No.: US 12,471,700 B2
(45) **Date of Patent: *Nov. 18, 2025**

(54) TABLE APPARATUS AND METHOD

(71) Applicant: Halcon Furniture LLC, Stewartville, MN (US)

(72) Inventors: Benjamin Saintmane Conway, Rochester, MN (US); Peter Conway, Stewartville, MN (US); Jacob Edward Snowbarger, Rochester, MN (US)

(73) Assignee: Halcon Furniture LLC, Stewartville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/658,033

(22) Filed: May 8, 2024

(65) Prior Publication Data

US 2024/0358150 A1 Oct. 31, 2024

Related U.S. Application Data

(63) Continuation of application No. 18/116,173, filed on Mar. 1, 2023, now Pat. No. 11,998,109, which is a continuation of application No. 17/499,363, filed on Oct. 12, 2021, now Pat. No. 11,596,223, which is a continuation of application No. 16/922,602, filed on Jul. 7, 2020, now Pat. No. 11,154,130, which is a continuation of application No. 16/681,375, filed on Nov. 12, 2019, now Pat. No. 10,743,654, which is a continuation of application No. 15/876,838, filed on Jan. 22, 2018, now Pat. No. 10,506,874.

(51) Int. Cl.
*A47B 13/08* (2006.01)
*A47B 21/06* (2006.01)

(52) U.S. Cl.
CPC ..... *A47B 13/083* (2013.01); *A47B 21/06* (2013.01); *A47B 2021/066* (2013.01); *A47B 2200/0001* (2013.01); *A47B 2200/0005* (2013.01); *A47B 2200/008* (2013.01); *A47B 2200/0081* (2013.01)

(58) Field of Classification Search
CPC . A47B 13/083; A47B 21/06; A47B 2021/066; A47B 2200/0001; A47B 2200/0005; A47B 2200/008; A47B 2200/0081
See application file for complete search history.

(56) References Cited

U.S. PATENT DOCUMENTS

| | | | |
|---|---|---|---|
| 1,690,286 | A | 11/1928 | Fitch |
| 1,810,579 | A | 6/1931 | Schmitz |
| 2,646,325 | A | 7/1953 | Abrahamson |
| 3,115,108 | A | 12/1963 | Craddock |

(Continued)

OTHER PUBLICATIONS

Dates Weiser, Highline Brochure, 2017, retrieved from: http://www.datesweiser.com/assets/DatesWeiser_Highline_Brochure 2017.pdf.

(Continued)

*Primary Examiner* — Hanh V Tran
(74) *Attorney, Agent, or Firm* — Fish & Richardson P.C.

(57) ABSTRACT

Some implementations of a table system can include a protective member that is positionable below a table to provide protection to both a table and chairs. The protective member can extend lateral beyond a peripheral edge of the table top, for example, to protect the table and accessory furniture while allowing the table top and the peripheral edge of the table top to remain exposed.

20 Claims, 4 Drawing Sheets

(56) References Cited

U.S. PATENT DOCUMENTS

| | | | |
|---|---|---|---|
| 4,117,782 | A | 10/1978 | Cahill |
| 4,558,553 | A | 12/1985 | Kolk |
| 4,946,727 | A | 8/1990 | Kessler |
| 5,424,108 | A | 6/1995 | Whetstone |
| 5,479,864 | A | 1/1996 | Kemp |
| 6,025,047 | A | 2/2000 | Catta et al. |
| 6,058,851 | A | 5/2000 | Alexander |
| 6,378,831 | B1 | 4/2002 | Copeland, Jr. |
| 7,748,106 | B1 | 7/2010 | Kinnard et al. |
| 8,181,579 | B2 | 5/2012 | Leng |
| 8,182,031 | B1 | 5/2012 | Mackenzie |
| 9,681,747 | B1 | 6/2017 | Pectol |
| 9,950,728 | B2 | 4/2018 | Weiser |
| 10,594,096 | B2 | 3/2020 | Rahner et al. |
| 2002/0112653 | A1 | 8/2002 | Moore |
| 2006/0096506 | A1 | 5/2006 | Brauning et al. |
| 2006/0102054 | A1 | 5/2006 | Warriner |
| 2007/0040483 | A1 | 2/2007 | Arkay-Leliever |
| 2010/0064945 | A1 | 3/2010 | Sierenberg |
| 2010/0104278 | A1 | 4/2010 | Livingston et al. |
| 2011/0163510 | A1 | 7/2011 | Wedi |
| 2012/0266789 | A1 | 10/2012 | Peery et al. |
| 2013/0305966 | A1 | 11/2013 | Hendershot |
| 2018/0325256 | A1 | 11/2018 | Hall et al. |

OTHER PUBLICATIONS

Dates Weiser [online], "Appendix. Appendix.—Highline Conference Table. March Open Conference Table Bases," Mar. 2015, retrieved from URL <https://silo.tips/download/appendix-appendix-highline-conference-table-march-open-conference-table-bases-ta>, 11 pages.

Prismatique.com [online], "Introducing Orbit + Porta Table Bases," Jun. 9, 2014, retrieved on Nov. 26, 2024, retrieved from URL <https://www.prismatique.com/News#Neocon2014>, 1 page.

Prismatique.com [online], "New Portaxl Mobile Conference + Ribbon Bases," Jun. 15, 2015, retrieved on Nov. 26, 2024, retrieved from URL <https://www.prismatique.com/News#Necon2015>, 1 page.

Prismatique.com [online], "Tabletop Materials," available on or before Sep. 28, 2017, via Internet Archive: Wayback Machine URL <https://web.archive.org/web/20170928223029/http://www.prismatique.com/Resources/Materials>, retrieved from URL <http://www.prismatique.com/Resources/Materials>, 6 pages.

DatesWeiser.com [online], "Technical Information," available on or before Jul. 21, 2017, via Internet Archive: Wayback Machine URL https://web.archive.org/web/20170721201246/http:/www.datesweiser.com/assets/DatDatesWei_Technical_Info2017.pdf>, retrieved on Jul. 29, 2025, retrieved from URL <http://www.datesweiser.com/assets/DatesWeiser_Technical_Info2017.pdf>, 325 pages.

TABLE APPARATUS AND METHOD

CROSS-REFERENCE TO RELATED APPLICATIONS

This application is a continuation of U.S. application Ser. No. 18/116,173, filed on Mar. 1, 2023, which is a continuation of U.S. application Ser. No. 17/499,363, filed on Oct. 12, 2021 (now U.S. Pat. No. 11,596,223), which is a continuation of U.S. application Ser. No. 16/922,602, filed on Jul. 7, 2020 (now U.S. Pat. No. 11,154,130), which is a continuation of U.S. application Ser. No. 16/681,375, filed on Nov. 12, 2019 (now U.S. Pat. No. 10,743,654), which is a continuation of U.S. application Ser. No. 15/876,838, filed on Jan. 22, 2018, (now U.S. Pat. No. 10,506,874), the contents of these aforementioned applications being fully incorporated herein by reference.

TECHNICAL FIELD

This document relates to a table apparatus and related systems and methods.

BACKGROUND

Tables, desks, and other work surfaces are often used in combination with a chair. Oftentimes, the chair is adjustable in height and includes arms. When people leave chairs, or move the chair to access different portions of the table, the arms and back of the chair can come in contact with an edge of the table, which can potentially cause damage to both the table edge and change. In addition, springing up of the seat and arms of the chair upon a person exiting the chair is very common. This is due to the typical relation of the arm of the chair to the table surface which is the result of human body geometry. For example, many people position their height-adjustable seating and its arm such that the arm is either directly parallel to the top surface of their desk or slightly below. Therefore, when one sits on the height-adjustable product, such as a spring gas cylinder equipped chair, the seating lowers a certain amount which places the position of the arm(s) below the surface. When leaving the table, the user may spin the seating away from the surface leaving one arm below the surface. Upon exiting the seating, the arm now returns to the initial position of the gas spring causing the arm to be pushed into the lower surface of the table or collide with an edge of the table.

This relationship between chairs and tables can cause damage to both the table and the arms of the chair. Generally, steps are taken to diminish damage of one item at the expense of the other. For example, metal arms for chairs make the chairs more durable to withstand damage, but can be more detrimental to tables. In addition, protection to the table often includes edging material that surrounds an edge of the table for protection, but this can increase damage to the chair. However, these modifications can diminish the aesthetics of the furniture.

SUMMARY

Some embodiments of a table system can include a sub-top member that is positionable below a table to provide protection to both a table and chairs. Moreover, the table system may provide an aesthetic and sleek appearance that does not obscure an edge of the table. In particular embodiments, the table system can include an electronics panel (e.g., positioned along the sub-top protector member) that provides connection of electronic devices to electrical ports coupled to the table.

In some embodiments, a table assembly may include a table top. The table top may define a table peripheral edge and a lower surface. The table assembly may also include a sub-top positioned below the lower surface of the table top. The sub-top may define a protective peripheral edge extending outwardly beyond the table peripheral edge by a first distance. The sub-top can be made of a first material that is softer than the table top. The first distance may be less than 1.5% of a minimum width of a major upper surface of the table top. The sub-top may be configured to protect chairs. The first material of the sub-top may be exposed along the protective peripheral edge. The first material of the sub-top may absorb impact from objects. Optionally, the sub-top may include a sub-top body, and the protective edge may surround a portion of the sub-top body. The protective edge and the sub-top body may be made of different materials. The table top may be made of at least one of wood, glass, stone, metal, laminate, and plastic. The sub-top may be made of a soft polymer material having an outer skin surface with that is different than the table peripheral edge of the table top. The sub-top may include an electronics connector. The electronics connector may be positioned below the protective edge on an exterior face of the sub-top. An exterior face of the electronics connector may be flush with the exterior face of the sub-top. The exterior face of the electronics connector can be angled inwardly from the protective peripheral edge of the sub-top. The electronics connector may include at least one of a power outlet, a USB port, an HDMI port, a VGA port, a video port, an audio port, a serial port, a parallel port a, a DVI port, a printer port, a game port, and an Ethernet port.

In another embodiments, a table assembly may include a table top having a major upper surface that is bordered by a table peripheral edge. The table assembly may also include means for protecting the table peripheral edge from lateral impacts. The protecting means may be mounted below the table top and positioned outwardly beyond the table peripheral edge by a first distance that is less than 1.5% of a minimum width of the major upper surface of the table top. The protecting means may include a sub-top positioned below the lower surface of the table top. The protecting means may include a first material that is softer than the table top and may be exposed below the table peripheral edge to absorb lateral impact from objects. The protecting means may be a means for protecting the table peripheral edge from lateral impacts of one or more chairs. The table top may be made of at least one of wood, glass, stone, metal, laminate, and plastic. The protecting means may be made of a soft polymer material having an outer skin surface that is different than the table peripheral edge of the table top. The protecting means may include an electronics connector positioned below an outer protective edge of the protecting means along a downwardly angled face of the protecting means. An exterior face of the electronics connector may be flush with the angled face of the sub-top.

Some embodiments include a method of assembling a table assembly. The method may include mounting a table top over a protective sub-top of the table assembly. The table top may have a major upper surface that is bordered by a table peripheral edge. A protective peripheral edge of the sub-top may be positioned below the table peripheral edge. The protective peripheral edge may extend parallel to and offset from the table peripheral edge such that the protective peripheral edge may extend outwardly beyond the table peripheral edge by a first distance for protecting the table peripheral edge from lateral impacts. The sub-top may be mounted below the table top so that the first distance is less than 1.5% of a minimum width of the major upper surface of the table top. The table top may be made of at least one of wood, glass, stone, metal, laminate, and plastic. The sub-top may be made of a soft polymer material having an outer skin surface that is different than the table peripheral edge of the table top.

Some embodiments include a method of protecting a table assembly and/or a chair. The method may include absorbing an impact of a chair along a lateral edge of a table assembly. The table assembly may include a table top mounted over a sub-top. The table top may have a major upper surface that is bordered by a table peripheral edge. The sub-top may have a protective peripheral edge positioned below the table peripheral edge and that may extend parallel to and offset from the table peripheral edge. The protective peripheral edge may extend outwardly beyond the table peripheral edge by a first distance means. The protective peripheral edge may include a soft polymer material that absorbs the impact to hinder the chair from contacting the table peripheral edge of the table top.

Some or all of the embodiments described herein may provide one or more of the following benefits. First, some embodiments of a table protector can provide protection of both an exterior peripheral edge of the table and an underside of the table. In some embodiments, the table protector can therefore minimize damage to accessory furniture, such as chairs. In particular embodiments, protection can be provided by the table protector regardless of a material of the table and/or the chairs. These materials can include, but are not limited to, wood, glass, stone, metal, laminate, plastic, and upholstery.

Second, some embodiments of the table protector described herein may be generally concealed under a top element of the table (e.g., positioned as a sub-top element) to provide an aesthetic appearance that maintains the decorative or otherwise desired top element, for example, as a formal conference table. In some embodiments, the table protector allows a top of the table and an exterior peripheral edge face of the top to remain exposed, without obstruction.

Third, some embodiments of the table protector described herein may provide incorporation of electronic or other componentry within the table protector. In particular embodiments, the incorporation of components are not visible from a topside of the table. In some embodiments, the incorporation of the electronics panel components do not interfere with a bottomside of the table protector. In some embodiments, the incorporation of the electronics panel components can be flush with a face of the table protector. In some cases, the incorporation of electronics panel components can be recessed into the table protector. In some cases, the incorporation of components can be provided such that the material is substantially similar to the table protector to provide a seamless incorporation.

Fourth, some embodiments of the table protector described herein can be resistant to scratches, chipping, and other forms of damage due to a material of the table protector. In some embodiments, a texture of the material can reduce damage and limit visibility to any damage that may occur due to excessive forces. In some embodiments, a geometry of the table protector can reduce damage and limit visibility to any damage that may occur due to excessive forces.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
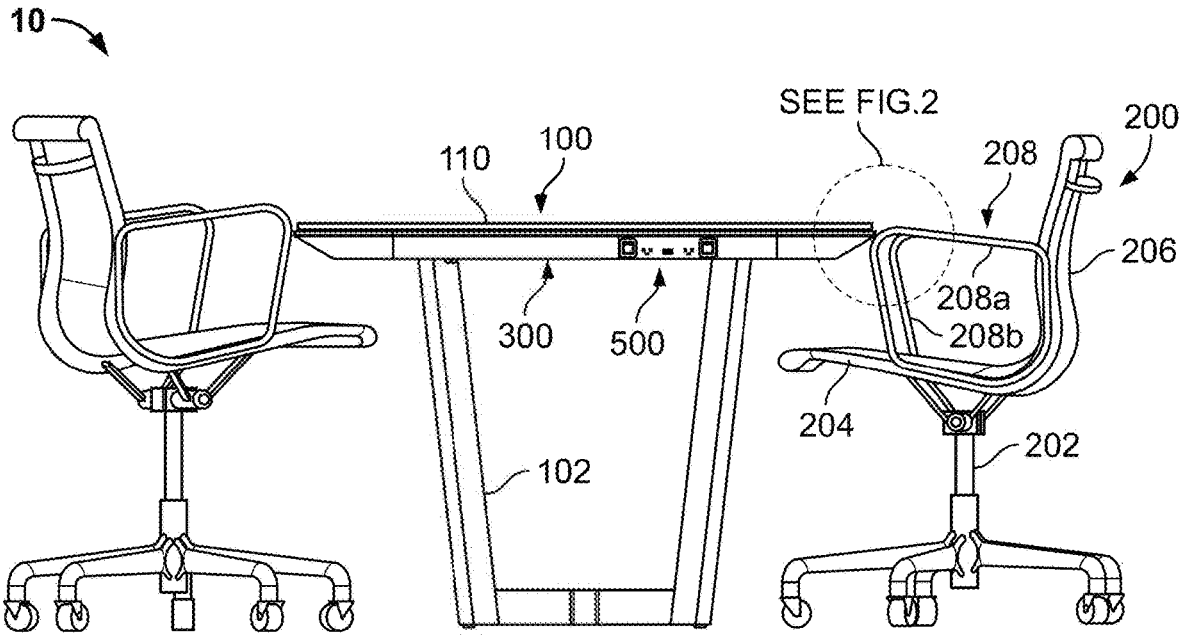
FIG. 1 is a side view of a conference room, in accordance with some embodiments provided herein.
Figure 2:
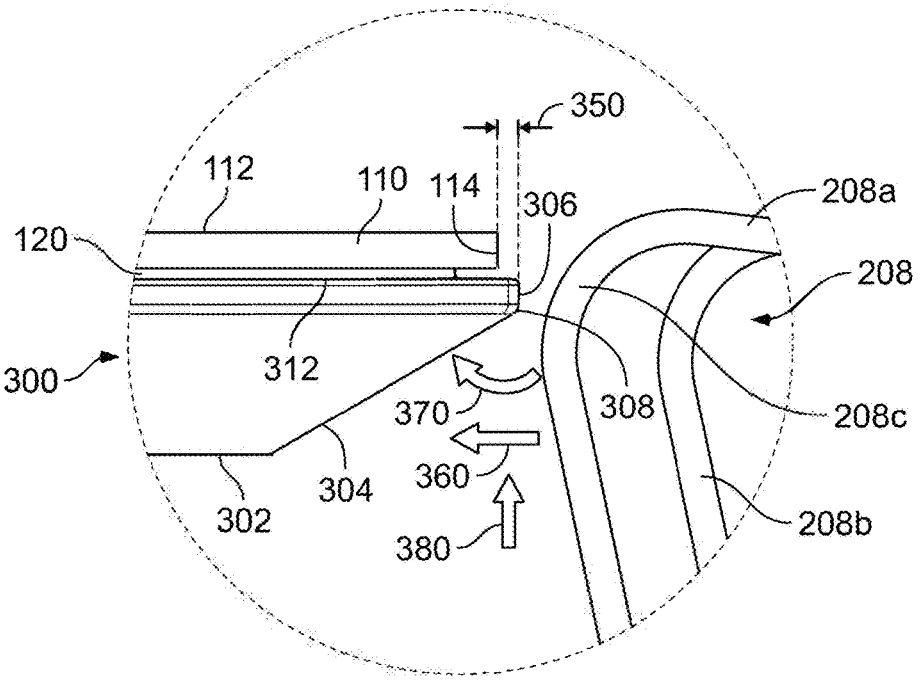
FIG. 2 is an enlarged side view of a corner of the table and table protector of FIG. 1, in accordance with some embodiments provided herein.

Referring to FIGS. 1 and 2, a table system 10 can include a table assembly 100 and one or more chairs 200. Table assembly 100 can include a table top 110, a table protector 300 located below table top 110, and legs 102. In this embodiment, the table protector 300 is implemented as a sub-top member so that the table top 110 and its exterior peripheral edge face 114 remain exposed. Legs 102 can extend below the table top 110 to support and elevate table assembly 100. In some cases, legs 102 can be attached to table top 110, the table protector 300, or a combination thereof.

Optionally, table top 110 can be formed of glass, wood, stone, metal, laminate, plastic, another material, or a combination thereof so as to provide a selected appearance, for example, as a formal conference table in the depicted embodiment. Table top 110 can include a top surface 112 and a peripheral edge face 114. In this embodiment, the peripheral edge face 114 is exposed along all sides of the table top 110 (e.g., along all four sides of the rectangular table top in the depicted embodiment). In some cases, top surface 112 and edge 114 can be made of the same material (e.g., a slab of solid material). Alternatively, top surface 112 can be made of one material (e.g., laminate) and edge 114 can be made of a different material (e.g., wood or a different material located under laminate). In this embodiment, the table protector 300 is arranged as a sub-top member so that top surface 112 and edge 114 are exposed and visible while the majority of the table protector is generally concealed from view.

Still referring to FIGS. 1 and 2, each of the chairs 200 can optionally include a seat 204 in combination with any or all of a back 206, arms 208, and an arm rest 208*a*. In some cases, arms 208 can include an arm support 208*b* and an arm edge 208*c*. For example, arm rest 208*a* may extend from back 206 substantially horizontally to seat 204, or at an angle to seat 204, to allow a user to rest an arm on arm rest 208*a*. In the depicted embodiment, arm support 208*b* can extend between arm rest 208*a* and seat 204 and provides arm edge 208*c* between arm rest 208*a* and arm support 208*b*. In some cases, arm edge 208*c* can be a portion of arm 208 that is located farthest from back 206, such that arm edge 208*c* can come in contact with objects, such as table assembly 110, during use of the chair 200. Optionally, chair 200 can include an actuation mechanism 202. Actuation mechanism 202 can allow a height of seat 204, back 206, and arms 208 to be modified. In some cases, actuation mechanism 202 can move seat 204, back 206, and arms 208 uniformly. Alternatively, actuation mechanism 202 can provide unique actuation of seat 204, back 206 and arms 208 separately. In some cases, actuation mechanism 202 can be a spring gas cylinder. In some cases, the height of seat 204, back 206, and/or arms 208 can change slightly when a person sits in chair 200 as compared to when chair 200 is empty. As shown in the depicted embodiment, chair 200 can be rotatable such that the seat 204, back 206, and other elements can be rotated by a user relative to the legs/ground-engaging components of the chair 200.

Table protector 300 is positioned relative to the table top 110 to protect table top 110 from damage caused by items (e.g., chair 200) coming into lateral contact with table assembly 100. In some cases, table protector 300 can protect chair 200 (e.g., arms 208, back 206) from damage caused by an impact at an outer periphery of the table assembly 100. For example, table protector 300 can be sized and shaped to protect table top 110 and/or chair 200 from damage due to a horizontal force 360 (e.g., arm 208 or back 206 being pushed into table assembly 100), rotational force 370 (e.g., rotation of chair 200 causing arm 208 or back 206 to contact table assembly 100), and/or vertical force 380 (e.g., height of arm 208 increasing due to a person leaving chair 200 or actuating chair 200 to increase height of chair 200). Preferably, table protector 300 can be made of a material that is resistant to damage (e.g., scratches, dents, chips, etc.) caused by impact. For example, table protector 300 can be made of a soft, resilient material, such as a polymer, cork, leather, etc., having an outer surface/skin that is configured to blend with, or add to, the outer decorative appearance of the table top 110. In some cases, a geometry of table protector 300 can reduce the likelihood of visible damage caused by an impact along an outer periphery of the table assembly 100. Optionally, table protector 300 can include a texture or pattern along its outer surface that can reduce the likelihood of visibility of any damage.

Still referring to FIGS. 1 and 2, some embodiments of the table protector 300 can include a lower surface 302 configured to protect an underside of table assembly 100. In some cases, lower surface 302 can protect table assembly 100 from damage caused by arms 208 raising into the lower surface 302. Table protector 300 can include an upper surface 312, which is optionally located directly below the lower surface of table top 110. Alternatively, upper surface 312 of table protector 300 can be spaced below table top 110 with a buffer 120. Buffer 120 can be part of table protector 300 that is raised above an edge of table protector 300 and can be sized such that buffer 120 is smaller (e.g., in length and width) than table protector 300 and/or table top 110, so that buffer 120 is limited in exposure and visibility.

In the depicted embodiment, lower surface 302 and upper surface 312 are separated via an angled edge 304. Angled edge 304 can provide increased overall thickness to table assembly 100 relative to table top 110 alone, such that a thinner piece of material can be used for table top 110, providing reduced costs for table assembly 100. In some cases, angled edge 304 can allow portions of chair 200 (e.g., arms 208) that are lodged under the table protector 300 to raise slightly, such as when a person exits chair 200 and causes an increase in height of arms 208. For example, as a person exits chair 200, if arm 208 is underneath angled edge 304, the arm 208 may rise slightly along the angled edge 304, thereby causing small horizontal movement of chair 200 as well. In some cases, angled edge 304 can have an angle between 10 degrees and 80 degrees. Alternatively, angled edge 304 can have a radius of curvature.

Table protector 300 can include a protective edge 306. In some cases, protective edge 306 can include rounded edges 308 between protective edge 306 and upper surface 312, protective edge 306 and angled edge 304, and/or protective edge 306 and lower surface 302. In the depicted embodiment, table protector 300 can be sized so protective edge 306 extends beyond exterior peripheral edge face 114 of table top 110 by a distance 350 (e.g., 1-10 mm), such that impact to table assembly 100 is received by protective edge 306 thereby protecting exterior peripheral edge face 114 of table top 110 from damage. Preferably, the distance 350 is relatively small compared to the major upper surface of the table top 110. For example, the distance 350 may be less than 1.5% (and optionally, 0.01% to 1.0%) of the minimum width of the major upper surface of the table top 110. In some embodiments, table protector 300 can include an electronics connector 500.

Figure 3:
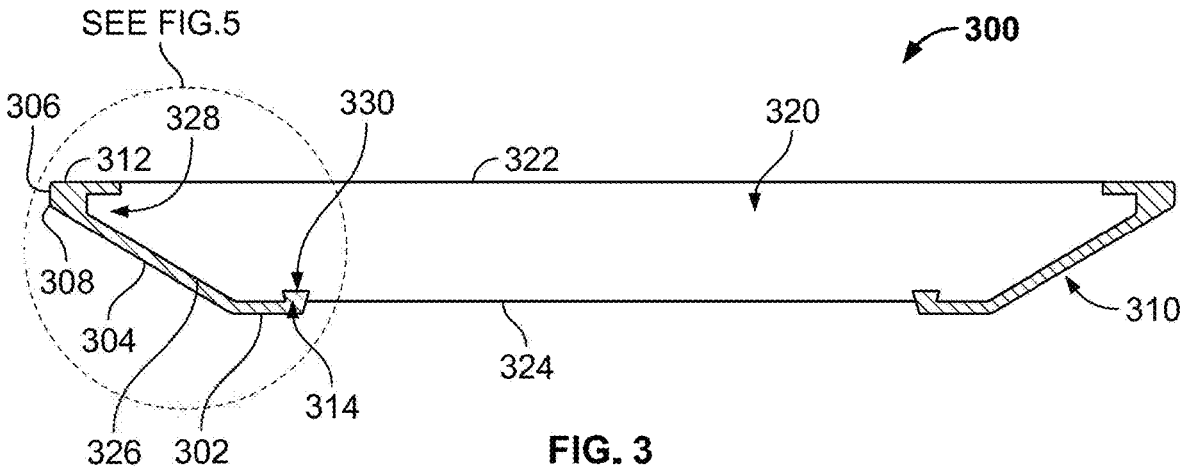
FIG. 3 is a cross-sectional view of the table protector of FIG. 1, in accordance with some embodiments provided herein.
Figure 5:
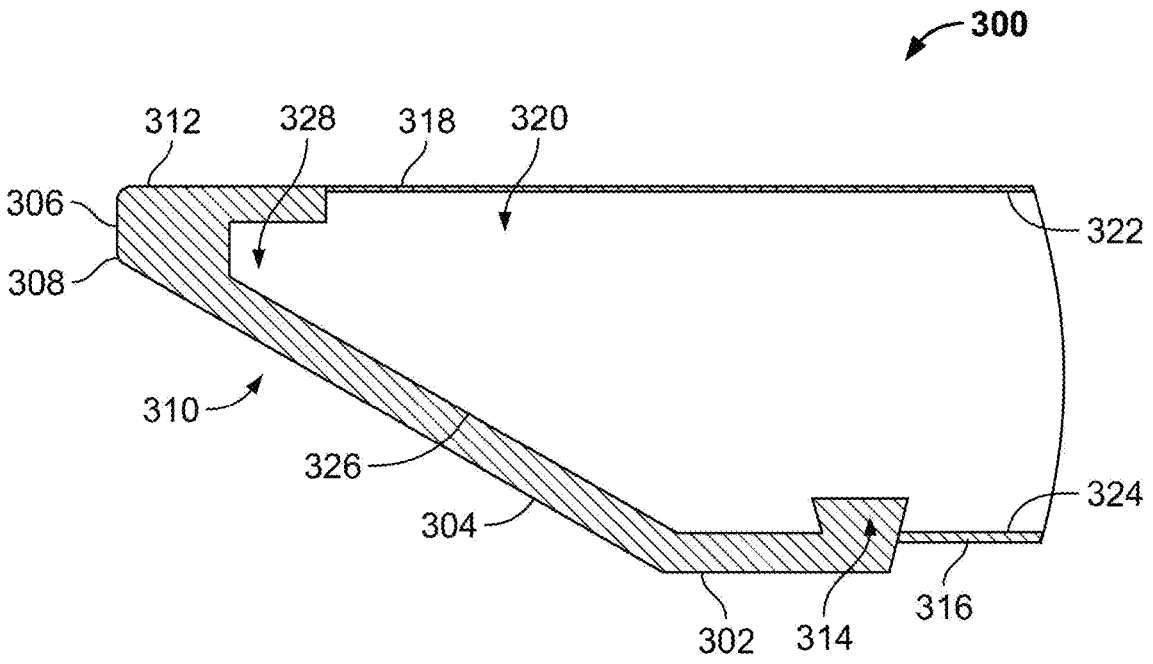
FIG. 5 is an enlarged cross-sectional view of an edge of the table protector of FIG. 3, in accordance with some embodiments provided herein.

Referring to FIGS. 3 and 5, the table protector 300 can include lower surface 302, angled edge 304, protective edge 306, rounded edge(s) 308 and upper surface 312, as described with respect to FIGS. 1 and 2. The table protector 300 can optionally include an upward protrusion 314, a lower surface extension 316, and an upper surface extension 318. These components of the table protector 300, or a subset of the components, may be collectively referred to as the table protector edge 310. In some embodiments, table protector 300 can include a table protector body 320 that provides structure between multiple table protector edges 310 (e.g., surrounding a conference table). Table protector body 320 can include an upper body surface 322, a lower body surface 324, an angled body edge 326, a corner body extension 328, and a body receiver 330.

Table protector body 320 can provide structural support to table protector 300 as table protector edge 310 may be made of a soft material. In some cases, table protector body 320 can also reduce costs of table protector 300. For example, table protector body 320 can be made of a material that is more cost effective than the material of table protector edge 310, such as wood, particle board, plastic, etc.

Upper body surface 322 extends along a top of table protector body 320. Upper body surface 322 may be exposed, such that upper body surface 322 abuts a lower surface of table top 110. Alternatively, upper surface extension 318 may extend from upper surface 312 along upper surface 322 such that upper surface extension 318 is between upper body surface 312 and a lower surface of table top 110. Upper surface extension 318 can be an extension of table protector edge 310 and can accordingly be made of a material similar to that of table protector edge 310. In some cases, upper body surface 322 can support buffer 120, as described with respect to FIGS. 1 and 2.

Similarly, lower body surface 324 extends along a bottom of table protector body 320. Lower body surface 324 may be offset vertically from lower surface 302 such that lower body surface 324 will not come into contact with chair 200 or a person in chair 200. Alternatively, when lower body surface 324 is flush with lower surface 302, or substantially flush with lower surface 302, lower surface extension 316 may extend from lower surface 302 along lower body surface 324 such that lower surface extension 316 provides protection between lower body surface 324 and chair 200, a person or other objects in contact with table system 10. Lower surface extension 316 can be an extension of table protector edge 310 and can accordingly be made of a material similar to that of table protector edge 310. Optionally, lower surface extension 316 can be offset vertically from lower surface 302. For example, a portion of lower surface 302 can be removed to create lower surface extension 324 higher than lower surface 302.

Still referring to FIGS. 3 and 5, angled body edge 326 of table protector body 320 can extend along an inside of angled edge 304 of table protector edge 310. This configuration can provide a flush coupling between table protector body 320 and table protector edge 310. Alternatively, the interior of table protector edge 310 may be rounded, rectangular, square, or another shape, and angled body edge 326 can be shaped to correspond with the shape of the interior of table protector edge 310. Angled body edge 326 can extend into corner body extension 328.

Corner body extension 328 can extend into protective edge 306 and provide a surface for upper surface 312. Alternatively, table protector body 320 may not include corner body extension 328. Instead, upper surface 312 may extend downward toward angled edge 304 rather than creating a gap.

Upward protrusion 314 can be position along, and extend upward from, lower surface 302 such that upward protrusion 314 can be inserted into body receiver 330 to aid in coupling table protector edge 310 and table protector body 320 together. In some cases, the geometry of the upward protrusion 314 and/or body receiver 330 can aid in retaining upward protrusion 314 in body receiver 330. Upward protrusion 314 and body receiver 330 can be shaped as compliments to one another to provide secure coupling of the table protector edge 310 and table protector body 320. Additionally, upward protrusion 314 can aid in protecting upholstered arms of chairs. For example, upholstered or foam padded arms of chairs, if trapped underneath lower surface 302, will conform to the upward protrusion 314 such that arms of the chair are not damaged.

Figure 4:
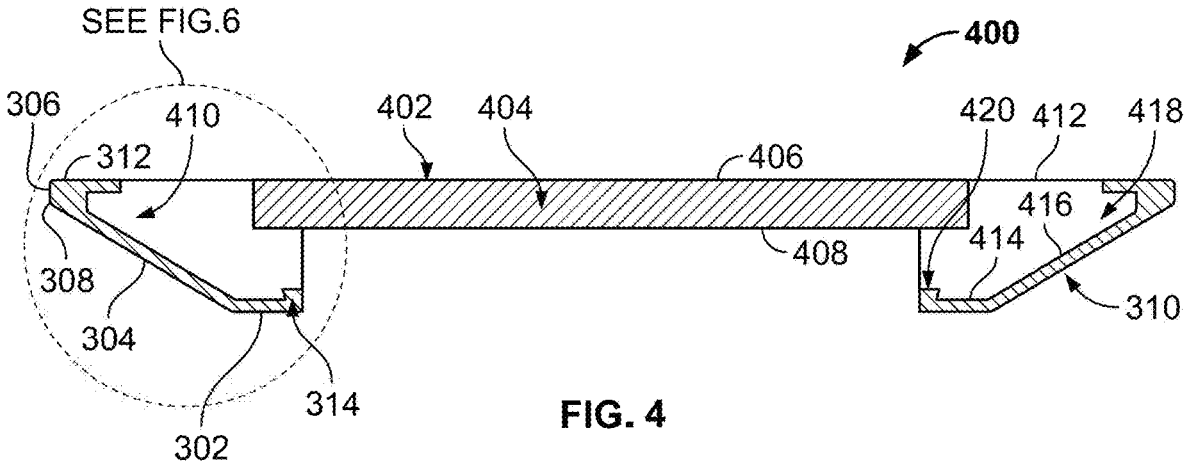
FIG. 4 is a cross-sectional view of a second embodiment of the table protector of FIG. 1, in accordance with some embodiments provided herein.
Figure 6:
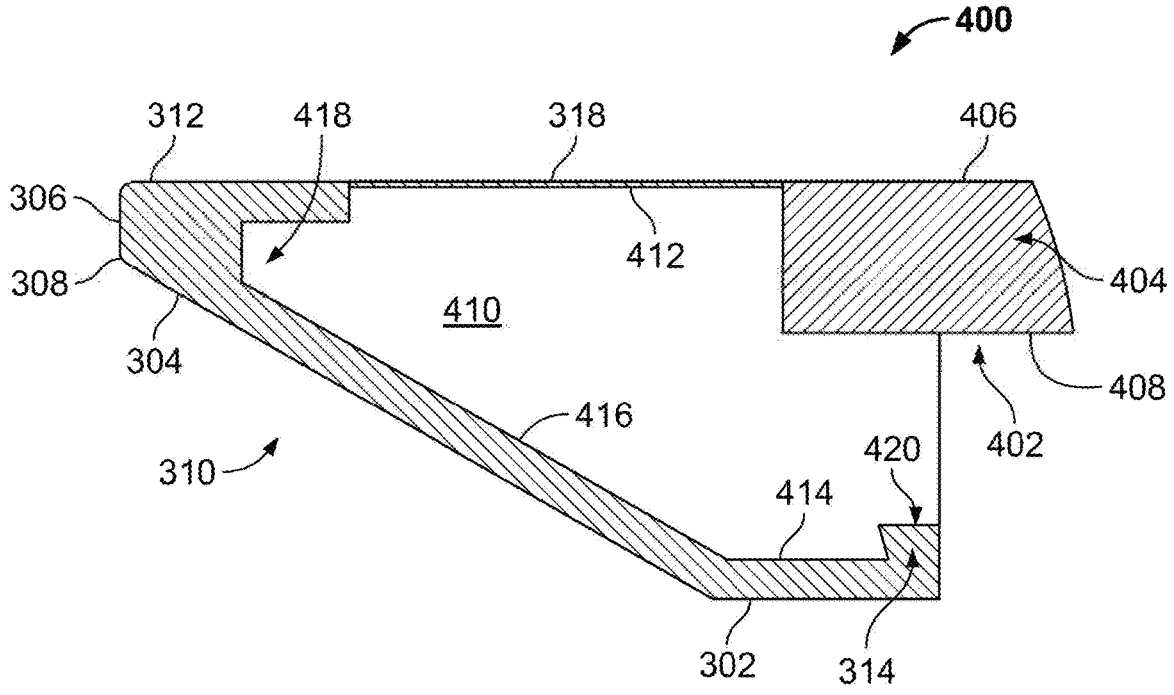
FIG. 6 is an enlarged cross-sectional view of an edge of the table protector of FIG. 4, in accordance with some embodiments provided herein.

Referring to FIGS. 4 and 6, a second embodiment of a table protector 400 can include a table protector edge 310 substantially similar to table protector edge 310 described with respect to FIGS. 3 and 5. The table protector 400 can further include a table protector body 402 which can include a body connector unit 404 and a body edge unit 410. In some cases, body connector unit 404 and body edge unit 410 are a single unit. Alternatively, body connector unit 404 and body edge unit 410 are separate units coupled together. Body connector unit 404 can include an upper body connector surface 406, and a lower body connector surface 408. Body edge unit 410 can include a body edge unit 410, a body edge upper surface 412, a body edge lower surface 414, an angled body edge 416, a body corner extension 418, and a body receiver 420.

The table protector edge 310 can include a combination of lower surface 302, angled edge 304, protective edge 306, rounded edge(s) 308, upper surface 312, upward protrusion 314, and an upper surface extension 318.

Table protector body 402 can provide structural support to table protector 300 as table protector edge 310 may be made of a soft material. In some cases, table protector body 402 can also reduce costs of table protector 300. For example, table protector body 402 can be made of a material that is more cost effective than the material of table protector edge 310, such as wood, particle board, plastic, etc. Body edge unit 410 can be received by table protector edge 310 and can coupled to body connector unit 404. Body connector unit 404 can extend between multiple body edge units 410 (e.g., surrounding a conference table).

Upper body connector surface 406 extends along a top of body connector unit 404. Upper body connector surface 406 may be exposed, such that upper body connector surface 406 abuts a lower surface of table top 110. Alternatively, upper surface extension 318 may extend from upper surface 312 along upper body connector surface 406 such that upper surface extension 318 is between upper body connector surface 406 and a lower surface of table top 110. Upper surface extension 318 can be an extension of table protector edge 310 and can accordingly be made of a material similar to that of table protector edge 310. In some cases, upper body connector surface 406 can support buffer 120, as described with respect to FIGS. 1 and 2.

Lower body connector surface 408 can extend along the bottom of body connector unit 404. Lower body connector surface 408 can be located higher than body edge lower surface 414, such that a space is created between body edge units 410. This space can be used to run cables for electronics connector 500, and limit the interference between cables and a lower portion of the table assembly 100. Further, additional costs can be saved by reducing the height of body connector unit 404.

Still referring to FIGS. 4 and 6, body edge upper surface 412 of body edge unit 410 can extend along an inside edge of upper surface 312 of table protector edge 310. This configuration can provide a flush coupling between edge body unit 410 and table protector edge 310. In some cases, body edge upper surface 412 may be exposed, such that edge body upper surface 412 abuts a lower surface of table top 110. Alternatively, upper surface extension 318 may extend from upper surface 312 along body edge upper surface 412 such that upper surface extension 318 is between body edge upper surface 412 and a lower surface of table top 110.

Similarly, body edge lower surface 414 of body edge unit 410 can extend along an inside of lower surface 302 of table protector edge 310. This configuration can provide a flush coupling between edge body unit 410 and table protector edge 310. Further, body edge lower surface 414 may extend between angled body edge 416 and body receiver 420.

Angled body edge 416 of body edge unit 410 can extend along an inside of angled edge 304 of table protector edge 310. This configuration can provide a flush coupling between edge body unit 410 and table protector edge 310. Alternatively, the interior of table protector edge 310 may be rounded, rectangular, square, or another shape, and angled body edge 416 can be shaped to correspond with the shape of the interior of table protector edge 310. Angled body edge 416 can extend into body corner extension 418.

Body corner extension 418 can extend into protective edge 306 and provide a surface for upper surface 312. Alternatively, body edge unit 410 may not include body corner extension 418. Instead, upper surface 312 may extend downward toward angled edge 304 rather than creating a gap.

Upward protrusion 314 can be position along, and extend upward from, lower surface 302 such that upward protrusion 314 can be inserted into body receiver 420 to aid in coupling table protector edge 310 and body edge unit 410 together. In some cases, the geometry of the upward protrusion 314 and/or body receiver 420 can aid in retaining upward protrusion 314 in body receiver 420. Upward protrusion 314 and body receiver 420 can be shaped as compliments to one another to provide secure coupling of the table protector edge 310 and table protector body 402. Additionally, upward protrusion 314 can aid in protecting upholstered arms of chairs. For example, upholstered or foam padded arms of chairs, if trapped underneath lower surface 302, will conform to the upward protrusion 314 such that arms of the chair are not damaged.

While table protectors 300 and 400 have been described with respect to various geometries, it should be realized that many other geometric configurations would also be suitable for table protectors 300 and 400. Further while table protectors 300 and 400 have been described with respect to being a sub-top for a table, such as a conference table, it is envisioned that the sub-top protector can be used for underneath any shape of table, as well as for other types of surfaces, such as other tables, desks, work surfaces, and/or cabinetry.

Figure 7:
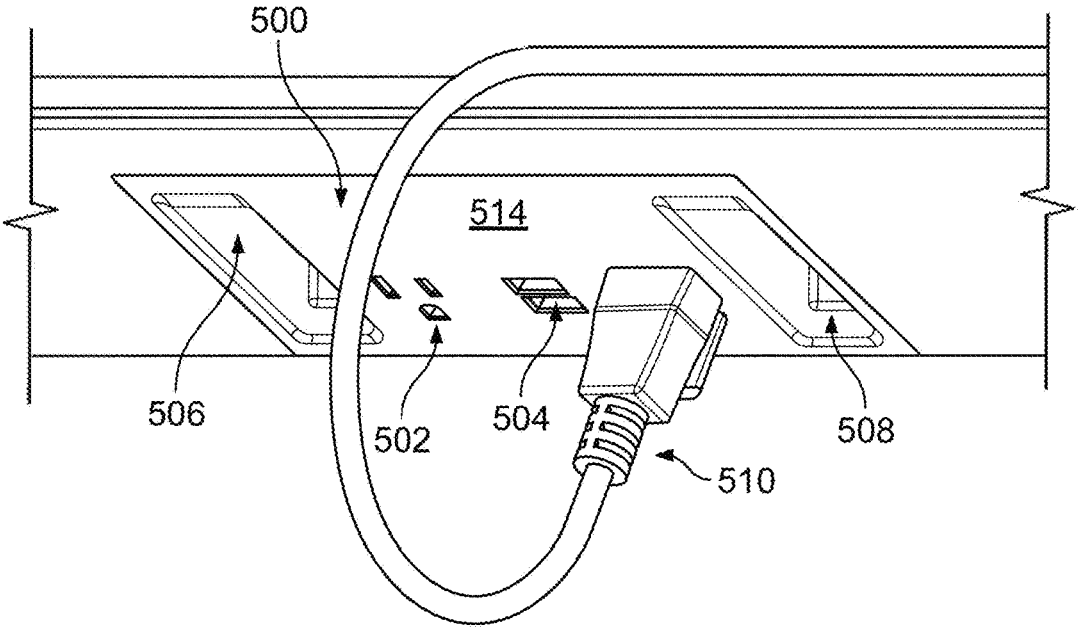
FIG. 7 is an enlarged perspective view of an electronics connector of the table protector of FIG. 1, in accordance with some embodiments provided herein.
Figure 8:
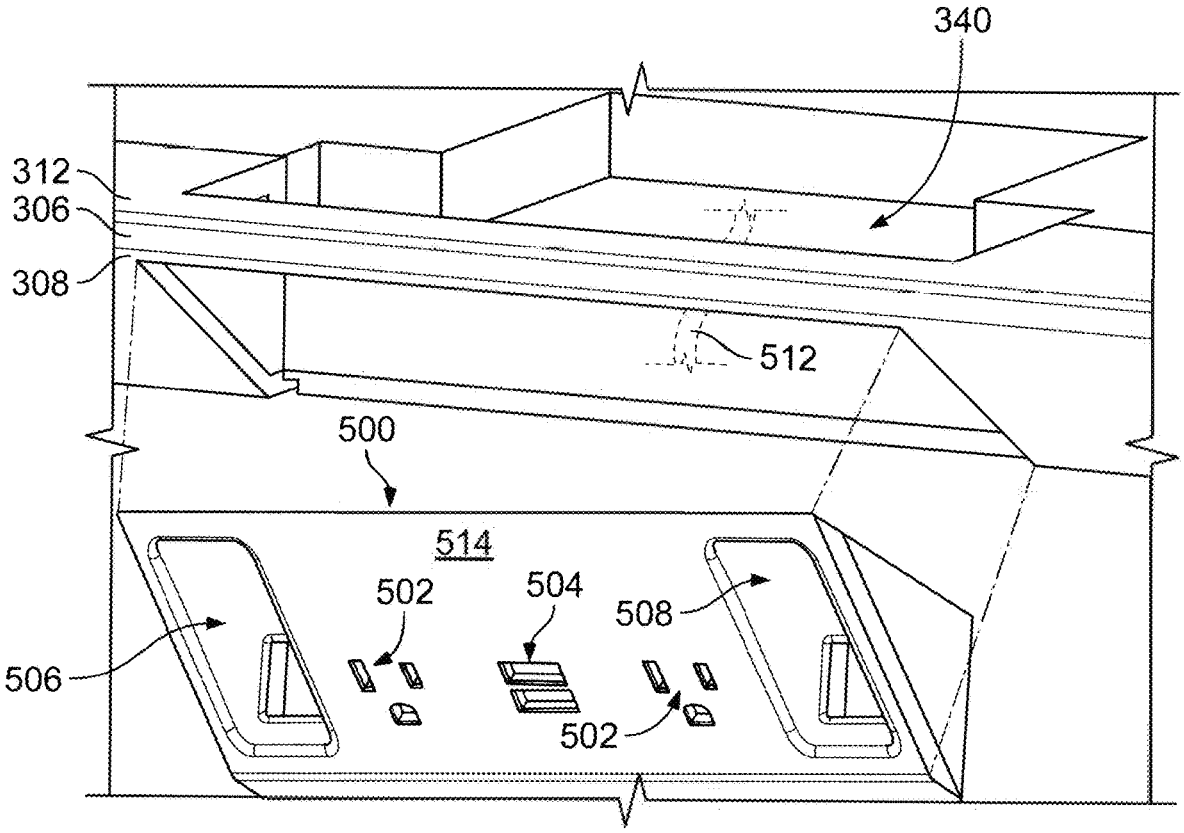
FIG. 8 is an enlarged perspective view of an electronics connector receiving area and an insert for the electronics connector of the table protector of FIG. 7, in accordance with some embodiments provided herein.

Referring to FIGS. 7 and 8, electronics connector 500 can be received in an electronics connector receiving area 340 of table protector 300. Electronics connector 500 include a variety of electrical component connection ports position along an electronics connector face 514. As shown in FIGS. 7 and 8, electronics connector 500 includes electrical outlets 502, USB ports 504, a first recessed port 506, and a second recessed port 508.

Electronics connector receiving area 340 can be located below protective edge 306 and rounded edge(s) 308, such that the electronics connector receiving area 340 is located on angled edge 304 of table protector 300. Electronics connector receiving area 340 can provide access of electronics connector cables 512 to electronics connector 500. In some cases, electronics connector 500 includes just a face panel that electrical ports can be received within. Alternatively, electronics connector 500 can include built-in electrical ports that can be coupled to the appropriate electronics connector cables 512. Electronics connector face 514 can be flush with angled edge 304 to provide a seamless integration of the electronics connector 500 and table protector 300.

Electrical outlets 502 and USB ports 504 are shown to be integrated flush with face 514. Electrical outlets 502 can receive a power cord 510. In another embodiment, an electrical port can extend into the cavity toward electronics connector face 514. The electrical ports can also include, but are not limited to, HDMI ports, VGA ports, video ports, audio ports, serial ports, parallel ports, DVI ports, printer ports, game ports, Ethernet ports, and any combination thereof. In addition, the ports can be mini or micro ports of the aforementioned ports.

In some embodiments, electronics connector 500 can be made of a material substantially similar to the material of table protector edge 310, such that electronics connector 500 possesses similar qualities as table protector edge 310. For example, electronics connector 500 can be made of material that is resistant to damage (e.g., scratches, dents, chips, etc.) caused by impact, such as a soft, resilient material having an outer surface/skin that is configured to blend with, or add to, the outer decorative appearance of the table top 110.

In some embodiments, the table protector can also include other elements positioned and connected similarly to electronics connector 500. For example, table protector 300 can include a drawer, a cup holder, and/or a table extension (e.g., a flat surface that can extend similar to a drawer, but provide additional table space).

A number of embodiments of the invention have been described. Nevertheless, it will be understood that various modification may be made without departing from the spirit and scope of the invention. Accordingly, other embodiments are within the scope of the following claims.

What is claimed is:

1. A table assembly, comprising:
- a table top having an exposed upper table top surface, a lower table top surface, and an exposed table peripheral edge between the exposed upper table top surface and the lower table top surface;
- a sub-top positioned entirely below the exposed lower table top surface, the sub-top joined with the table top, the sub-top comprising:
  - a sub-top upper surface that is at least partially exposed, the sub-top upper surface parallel to the exposed upper table top surface,
  - a sub-top peripheral exposed vertical surface that extends outwardly beyond the exposed table peripheral edge by a first distance, and
  - a sub-top peripheral exposed angled surface at a height below the sub-top peripheral exposed vertical surface and extending inwardly at an angle relative to the sub-top peripheral exposed vertical surface, and an exposed electronics connector positioned on the sub-top peripheral exposed angled surface vertically below the sub-top peripheral exposed vertical surface and inwardly from the sub-top peripheral exposed vertical surface.

2. The table assembly of claim 1, wherein the sub-top peripheral exposed vertical surface and the sub-top peripheral exposed angled surface are integrally formed as a single component.

3. The table assembly of claim 1, wherein the sub-top peripheral exposed vertical surface and the sub-top peripheral exposed angled surface are made of the same material.

4. The table assembly of claim 1, wherein the first distance is less than 1.5% of a minimum width of the exposed upper table top surface.

5. The table assembly of claim 1, wherein the exposed upper table top surface comprises a first material, and the sub-top peripheral exposed angled surface comprises a second material different from the first material.

6. The table assembly of claim 5, wherein the second material is softer than the first material.

7. The table assembly of claim 6, wherein the sub-top is configured to protect chairs.

8. The table assembly of claim 5, wherein the sub-top further comprises a sub-top body, wherein the sub-top peripheral exposed angled surface is affixed with the sub-top body, wherein the sub-top peripheral exposed angled surface and the sub-top body comprise different materials.

9. The table assembly of claim 5, wherein the sub-top peripheral exposed vertical surface is not in contact with the exposed table peripheral edge.

10. The table assembly of claim 5, wherein the first material is at least one of wood, glass, stone, metal, and laminate.

11. The table assembly of claim 10, wherein the sub-top peripheral exposed vertical surface comprises a soft polymer material having an outer skin surface that is different than the first material that defines the exposed table peripheral edge.

12. The table assembly of claim 5, wherein the exposed upper table top surface and the exposed table peripheral edge are made of a same material.

13. The table assembly of claim 12, wherein the sub-top peripheral exposed angled surface defines a receiving area that accommodates the electronics connector.

14. The table assembly of claim 12, wherein the electronics connector is recessed relative to the sub-top peripheral exposed angled surface.

15. The table assembly of claim 14, wherein the electronics connector comprises a third material, the third material is the same as the second material.

16. The table assembly of claim 12, wherein the sub-top comprises a sub-top lower surface parallel to the sub-top upper surface.

17. The table assembly of claim 16, wherein the sub-top peripheral exposed angled surface extends between the sub-top peripheral exposed vertical surface and the sub-top lower surface.

18. The table assembly of claim 17, wherein the exposed electronics connector is positioned vertically between the sub-top peripheral exposed vertical surface and the sub-top lower surface.

19. The table assembly of claim 8, wherein the lower table top surface is abutted to an upper body surface of the sub-top body.

20. The table assembly of claim 19, wherein the lower table top surface is abutted to the upper body surface of the sub-top body by an intermediary buffer.

* * * * *